US012458868B2

(12) United States Patent
Fowler

(10) Patent No.: US 12,458,868 B2
(45) Date of Patent: Nov. 4, 2025

(54) SNOOKER POCKET RAIL

(71) Applicant: Carl Fowler, Chorley (GB)

(72) Inventor: Carl Fowler, Chorley (GB)

( * ) Notice: Subject to any disclaimer, the term of this patent is extended or adjusted under 35 U.S.C. 154(b) by 407 days.

(21) Appl. No.: 17/885,782

(22) Filed: Aug. 11, 2022

(65) Prior Publication Data

US 2024/0050837 A1 Feb. 15, 2024

(51) Int. Cl.
*A63D 13/00* (2006.01)
*A63D 15/00* (2006.01)

(52) U.S. Cl.
CPC ..... *A63D 15/003* (2013.01); *A63D 15/00* (2013.01); *A63D 2015/008* (2013.01)

(58) Field of Classification Search
CPC . A63D 15/003; A63D 15/00; A63D 2015/008
USPC ..... 473/28
See application file for complete search history.

(56) References Cited

U.S. PATENT DOCUMENTS

| | | | | |
|---|---|---|---|---|
| 223,098 A * | 12/1879 | Bayliff | ..... | A63D 15/06 473/4 |
| 2,047,048 A | 7/1936 | Abbott et al. | | |
| 2024/0050837 A1* | 2/2024 | Fowler | ..... | A63D 15/00 473/28 |

FOREIGN PATENT DOCUMENTS

| | | | | |
|---|---|---|---|---|
| FR | 2707888 A1 | 1/1995 | | |
| GB | 191215617 A | 9/1912 | | |
| GB | 290454 A | 5/1928 | | |
| GB | 2529159 A * | 2/2016 | ..... | A63D 15/00 |

OTHER PUBLICATIONS

Search Report mailed Jan. 21, 2022 in corresponding United Kingdom Application No. GB2104846.7, 8 pages.

* cited by examiner

*Primary Examiner* — Mitra Aryanpour
(74) *Attorney, Agent, or Firm* — MH2 TECHNOLOGY LAW GROUP LLP; Stuart I. Smith

(57) ABSTRACT

A snooker pocket rail system (10) that provides an atmospheric control system (24) for heating the atmosphere in a region adjacent the rails (14) where one or more balls (18) are supported in use. This maintains the temperature of the balls (18) when not in play—so as to reduce adverse playing effects, such as "kick", when the balls (18) are placed back onto the snooker table. The snooker pocket rail system (10) has a ball ring (12) from which the pocket rail (14) is suspended, in use, below a pocket by a net; an end stop (20); a plurality of rails (14) affixed at one end to the ball ring (12) and at their opposite ends to the end stop (20); and suspension means (26). The atmospheric control system (24) can be a heated air supply which directs (80, 84) heated air onto the balls (18) when suspended on the rails (14), or heated rails (14).

20 Claims, 4 Drawing Sheets

SNOOKER POCKET RAIL

BACKGROUND

This invention relates to improvements in relating to snooker pocket rails. Snooker, and games like snooker, such as billiards and pool, are played using plastics balls on a knapped fabric surface. The object of play is to cause the balls to drop into pockets by hitting one ball against another using a cue. Typically, the white ball or cue ball is struck using the cue, and the cue ball hits another ball, which is deflected into a pocket during play.

Mathematically, it is possible to calculate angles and speeds at which the balls will move during a collision event, and with considerable practice, such as is obtained by professional players, this can become instinctive. However, there are certain artefacts of playing, which can cause the balls to move in unintended directions and/or speeds, and this is due to a number of physical and/or environmental factors.

Because the balls are manufactured from plastics and are designed to roll across the fabric surface, the coefficient of friction is generally quite low. However, if a ball skids, rather than rolls, which could occur if the ball is contaminated with dust, grease, or anything else, then it may have a tendency to slide over the fabric surface, rather than roll, which can cause static electricity to build up on the ball's surface. Then, at the point of impact with another ball, charge can be transferred from one ball to the next, and this electrostatic discharge can give rise to an effect known as "kick". During a "kick" collision, the impacting and impacted balls do not necessarily appear to observe the laws of classical physics (conservation of momentum) due to the additional impetus caused by the electrostatic discharge. Indeed, it is possible for one of the balls to actually jump off the table surface and bounce somewhat during a "kick" collision event. This gives rise to unpredictability in play and is often the difference between winning and losing a professional game.

In order to ameliorate against this, various steps are taken, such as temperature-controlling the table surface by heating the slate layer underneath the fabric covering; by pre-heating the balls before they are wrapped up and placed on the table so as to minimise temperature differentials between them (the heated slate also contributing to maintaining consistent ball temperature throughout game play); and controlling the environmental conditions within the playing room. Moreover, other steps can be taken, such as regularly brushing the fabric surface between game play so as to lay the knap in a consistent direction, cleaning the balls whenever they are reset and using dust-free chalk on the cue tips. However, even these measures are often insufficient to eliminate kick, a solution is therefore needed to address this problem, which the present invention aims to provide.

SUMMARY OF THE INVENTION

Aspects of the invention are set forth in the appended independent claim or claims. Preferred and/or optional features of the invention are set forth in the appended dependent claims.

According to one aspect of the invention, there is provided a snooker pocket rail system comprising: a ball ring from which the pocket rail is suspended, in use, below a pocket by a net; an end stop; a plurality of rails affixed at one end to the ball ring and at their opposite ends to the end stop; and suspension means for suspending, in use, the end stop below a table, wherein the snooker pocket rail further comprises an atmospheric control system for heating the atmosphere in a region adjacent the rails where one or more balls are supported in use.

According to another aspect of the invention, there is provided a snooker, pool or billiards table comprising one or more snooker pocket rail systems as described herein.

The present invention works by providing a heating/environmental control system for the balls when they are not in-play. A lengthy frame of snooker, for example, can take up to an hour to play and the balls, once potted, simply rest in the pocket rails below the table. During this time, no attempt is made to regulate the environment that the balls are kept in, and this can lead to balls cooling down, attracting contamination, becoming humid, etc. whilst a game is in-play but whilst the ball itself is not in use. The problem is further exacerbated because the balls tend to be potted one after another, and so the first ball to be potted usually has a much lower temperature than the last ball to be potted when the balls are re-racked for the next round of play. Having different ball temperatures can exacerbate the effects of kick and can also have more straightforward implications, such as thermal expansion/contraction of the balls giving rise to differences in diameter, etc.

However, by ensuring that the balls are kept in an environmentally controlled location once they have been potted, many of the aforesaid issues can be overcome.

Suitably, the atmospheric control system comprises means for heating the rails. This could be by way of directly heating the rails, for example, by using a heating element, or by blowing warm air through them. The latter can be accomplished by providing a housing which has a fan and a heater and by providing at least one tubular rail. The downstream side of the fan can be in fluid communication with the bore of the tubular rail so as to direct heated air inside the rail so as to heat it. In certain embodiments of the invention, the tubular rail is perforated or apertured so as to direct heat there inside the rail towards and/or over a ball or balls supported by the rail.

Additionally or alternatively, the atmospheric control system may comprise a housing which contains a fan on a heater and in which the downstream side of the fan is in fluid communication with one or more apertures in a wall of the housing. The apertures are suitably arranged to direct heated air towards and/or over a ball supported by the rails.

In one embodiment of the invention, the ball rails are surrounded by a cover, preferably a thermally insulating cover, which reduces the amount of heat loss from the balls to the environment and also shields the balls from airborne contamination and drafts, etc. Preferably, the cover is made from a transparent, insulating glass material, (e.g., Pilkington® K-Glass®) such that heat is retained within the cover and such that the pocketed balls are visible therethrough.

In a preferred embodiment of the invention, the balls are actively temperature regulated in the pocket rails, and this could be achieved, for example, by providing a heating element within the afore-described insulated tube. In order to be able to gain access to the balls when they are in the insulated tube, the insulated tube preferably has a hatch or doorway, which can be lifted or removed to gain access to the interior thereof, and so access the balls within it.

Preferably, the pocket rails themselves are heated, for example, by being manufactured from tubes with heating elements located within the interior bore of the tubes. Additionally or alternatively, the pocket rails could be tubular and have a stream of hot air passing through them so as to maintain their temperature. In a most preferred embodiment of the invention, a hot air system is provided, which blows air through tubular pocket rails, and wherein the pocket rails have apertures therein to allow respective jets of heated air to be blown onto the balls. In order to control the atmosphere better around the balls, the hot air blown into the tubes, in this situation, is suitably dehumidified and/or decontaminated. This can be accomplished, for example, by using a filtration system and/or a liquid trap or dehumidifying device. In one possible embodiment of the invention, a fan is provided, which has an upstream filter and dehumidifier (e.g., silica crystals) and a downstream outlet connected to the internal bore of the pocket rails.

Suitably, any temperature control is thermally regulated, and this could be accomplished, for example, by using a thermostatic controller or, more preferably, by using a PTC (positive temperature coefficient) heating element, which self-regulates its temperature in a manner that will be well-understood by the person skilled in the art.

A most preferred embodiment of the invention sees the pocket system comprising a combination of conditioned air provision as well as environmental isolation as explained in greater detail herein below.

DETAILED DESCRIPTION OF THE INVENTION

Figure 1:
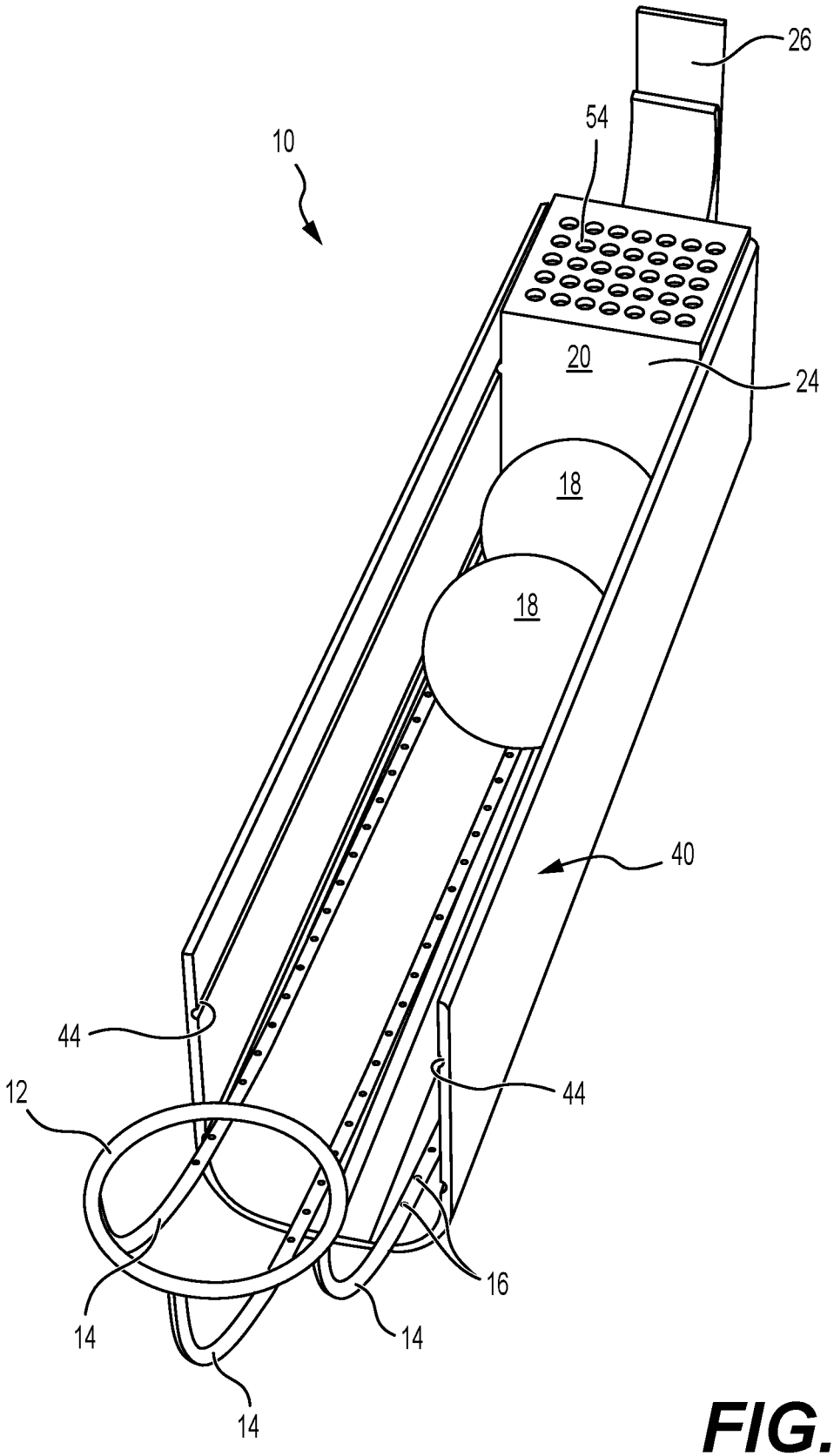
FIG. 1 is a perspective view of an embodiment of a pocket rail in accordance with an embodiment of the invention.

Referring firstly to FIG. 1 of the drawings, a pocket rail system 10 in accordance with the invention comprises a ball ring 12, which is suspended below a snooker table pocket (not shown) by a net (not shown for clarity). Suspended from the ring 12 are three rails 14, on which the snooker balls 18 are supported, once pocketed during play. Thus far, the construction of the pocket rail is largely conventional.

However, it will be seen, in particular from FIGS. 1, 3, 4 and 5 that each of the rails 14 is tubular (rather than being formed from metal rod), and has perforations 16 providing a fluid passageway from the exterior of the rail 14 to the internal bore 18. Once pocketed, the balls drop through the ring 12, are caught on the rails 14 and due to the slight incline of the rails 14, come to rest at the far end thereof, as shown in FIGS. 1, 3, 4 and 5. Further potted balls simply line-up on the rails 14 as will be well understood by the skilled reader.

To stop the balls 18 from falling off the rails 16, an end stop 20 is provided. The end stop 20 is formed as the end wall of a hollow housing 24 as shall be described in greater detail herein below. The tubular rails 16 penetrate the end wall 20 of the housing 24 and a fluid passageway is thus formed between a hollow interior volume of the housing 24, the tubular rails 14 and the perforations 16.

A D-ring 30 is affixed to the housing 24, and this enables the housing 24 to be suspended below a snooker table (not shown for clarity) in the usual way, using a leather strop 26. By supporting the rail system 10 by the net (not shown) attached to the ring 12 and by the strop 26 attached to the D-ring 30, the impact of the balls 18 as they drop onto the rails 14 and/or collide with the end wall 20 of the housing 24 is absorbed somewhat.

The object of the invention, as previously described, is to maintain the balls 18 in an as environmentally-controlled manner as possible. This is accomplished, in the embodiments shown by providing a cover 40, which at least partially encircles the balls 18 when they are retained by the rails 14. As can be seen, most clearly in FIG. 5 of the drawings, the side walls of the housing 24 have outwardly projecting ribs 42, which slidingly engage with complementary elongate grooves 44 of the cover 40. This means that the cover 40 can be moved between a ball storage position as shown in FIG. 2, in which the cover 40 encloses the balls 18; and a retracted position, as shown in FIG. 3, whereby access to the balls can be obtained, for example to re-rack them on the snooker table.

Figure 2:
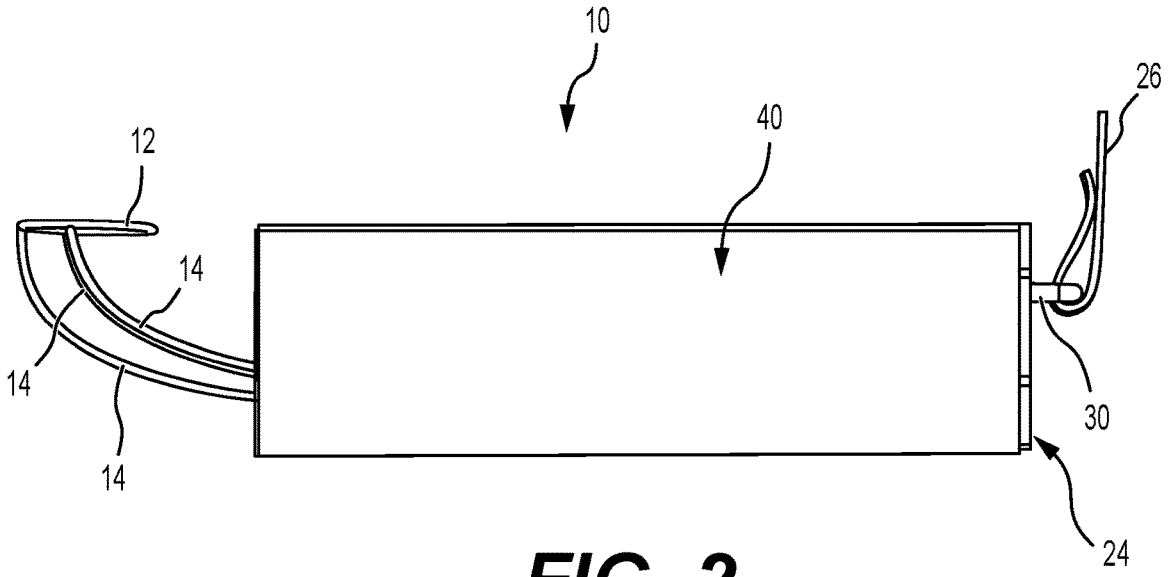
FIG. 2 is a side view of the pocket rail shown in FIG. 1.
Figure 3:
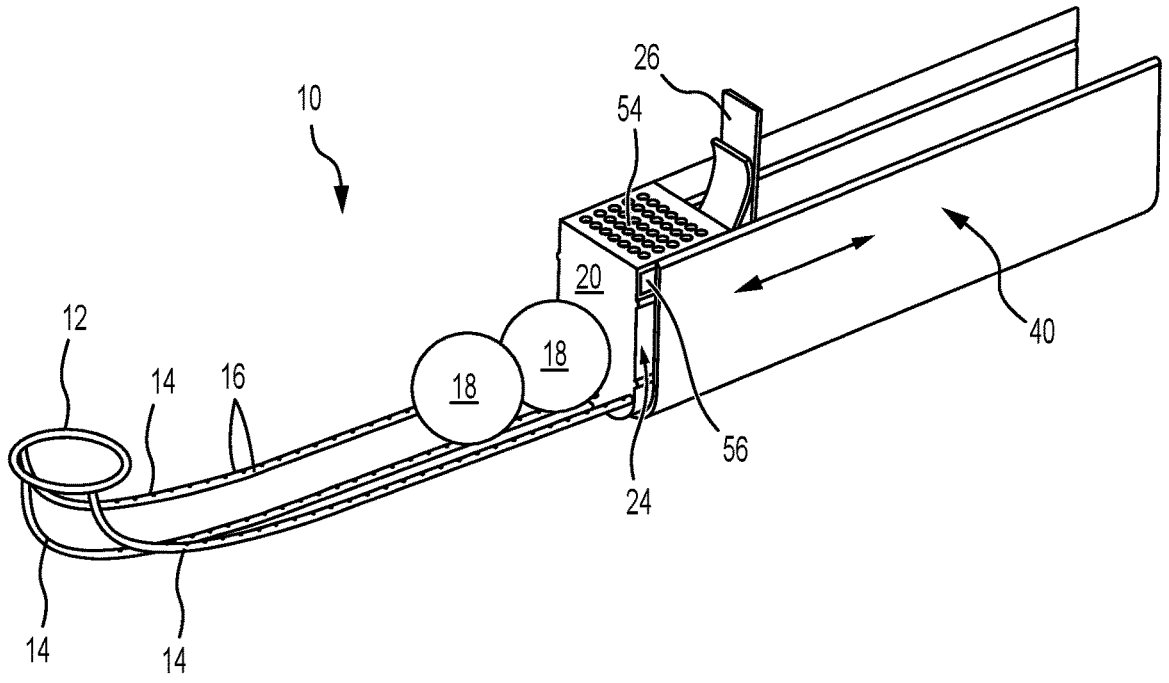
FIG. 3 is a perspective view of the pocket rail shown in FIGS. 1 and 2 with its cover retracted.

During normal play, the cover 40 is moved to the position shown in FIG. 2, but when a ball 18 needs to be recovered, the cover 40 can be slid so it is retracted to facilitate access to the balls 18 as and when needed. It will be appreciated that the provision of the cover 40 shields the balls 18 somewhat from drafts, dust, heat sources and the like.

In addition to the foregoing, the housing 24 also contains a heating/air control system.

Figure 5:
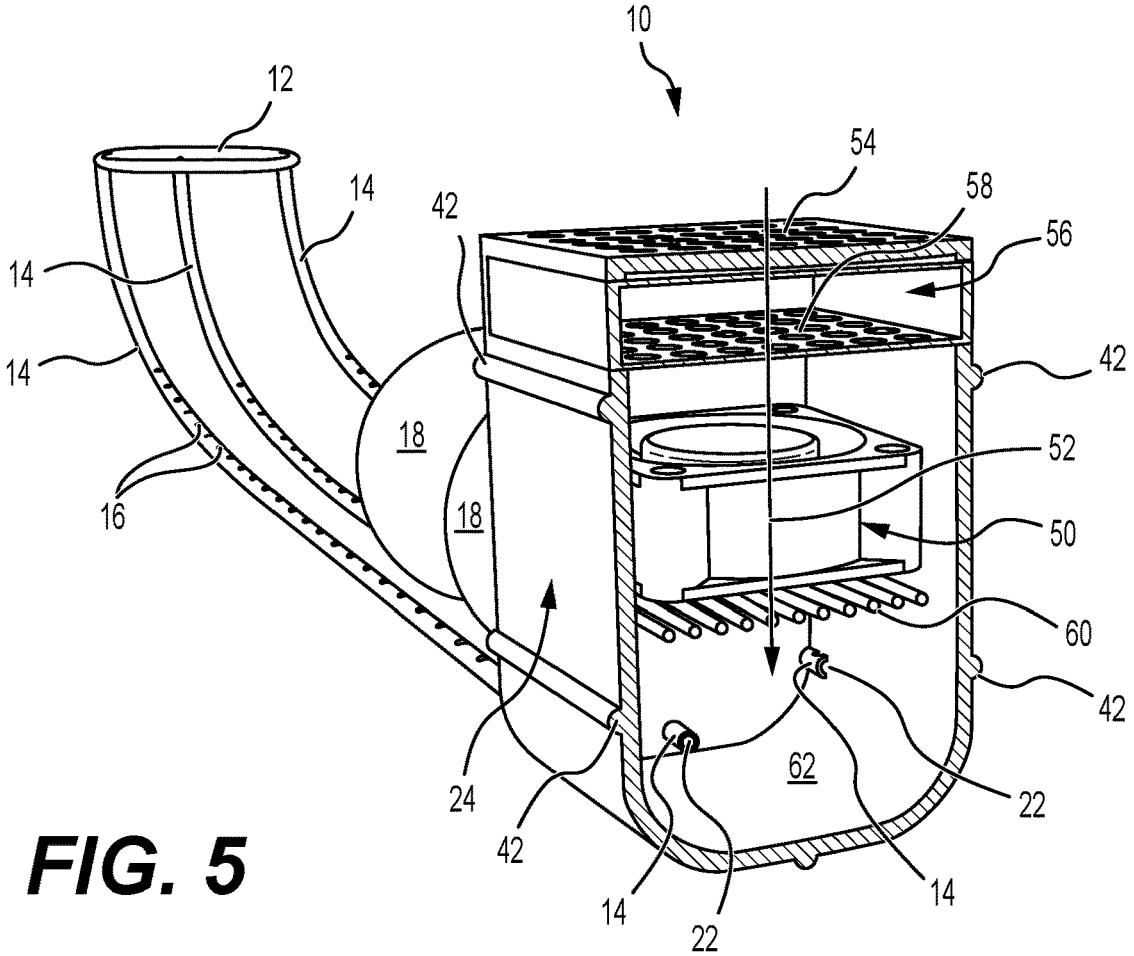
FIG. 5 is a perspective, partial cross-sectional view of the pocket rail of FIGS. 1 to 4 showing an embodiment of its internal workings.

Referring, in particular, to FIG. 5 of the drawings, the housing 24 has hollow interior volume, which houses a fan 50, which is arranged to direct airflow in the direction of arrow 52. The fan 50 is preferably battery powered. Air is drawn in through a grille formed on an upper wall of the housing 24, through a tray/drawer 56 containing a quantity of dehumidifying crystals such as silica crystals (not shown for clarity), through a secondary grille 58 at the bottom of the tray 56, through the fan 50, through a heater grille 60 and into a plenum chamber 62 located at the bottom of the housing 24. This arrangement creates a positive air pressure within the plenum 62, which is filled with pressurised, warm, dried air. The only escape route for the pressurised air is thus through the bores 22 of the rails 16, and so warmed, dried air is blown through the tubular rails 14 and out through the perforations 16 thereof. As can be seen from the drawings, the arrangement of the perforations 16 is such that they direct a curtain of warm, dried air over the balls 18. This serves to maintain them at a desired temperature.

A further function of the cover 40 is that it minimises heat loss and contains, somewhat, the warm, dried air thus helping to maintain the balls 18 at a constant temperature and/or humidity.

Figure 4:
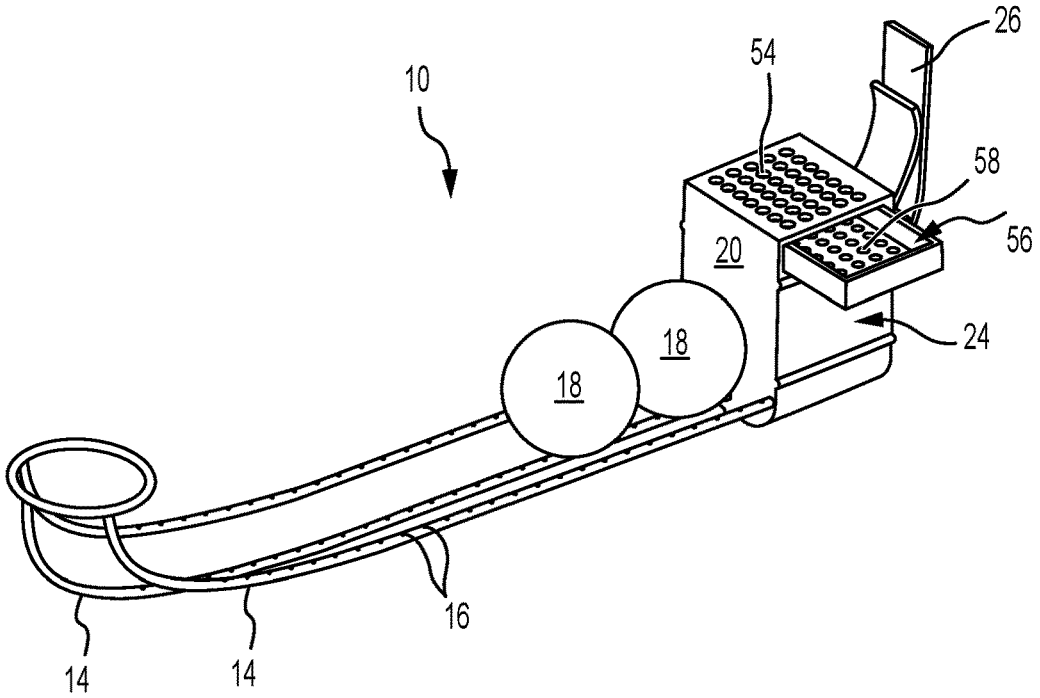
FIG. 4 is a perspective view of the pocket rail shown in FIG. 3, with the cover removed and the drawer withdrawn.

When it is desired to replenish the silica crystals (not shown) the tray 56 can simply be retracted, as shown in FIG. 4 and its contents replaced/replenished as need be. The tray 56 can then simply be pushed back in for re-use and the cover 40 slid back over the housing 24 so that the device 10 is ready again for use.

In order to ensure that the balls 18 are kept under optimum conditions, various temperature and/or humidity sensors may be provided. Locations for these could be within the plenum chamber 62, within the cores 22 of the rails 14, within the housing 40 etc. A thermostatic control system is suitably provided, which controls the operation of the fan 50 and the heater coil 60 so as to ensure that the balls 18 are maintained as a desire temperature.

Figure 6:
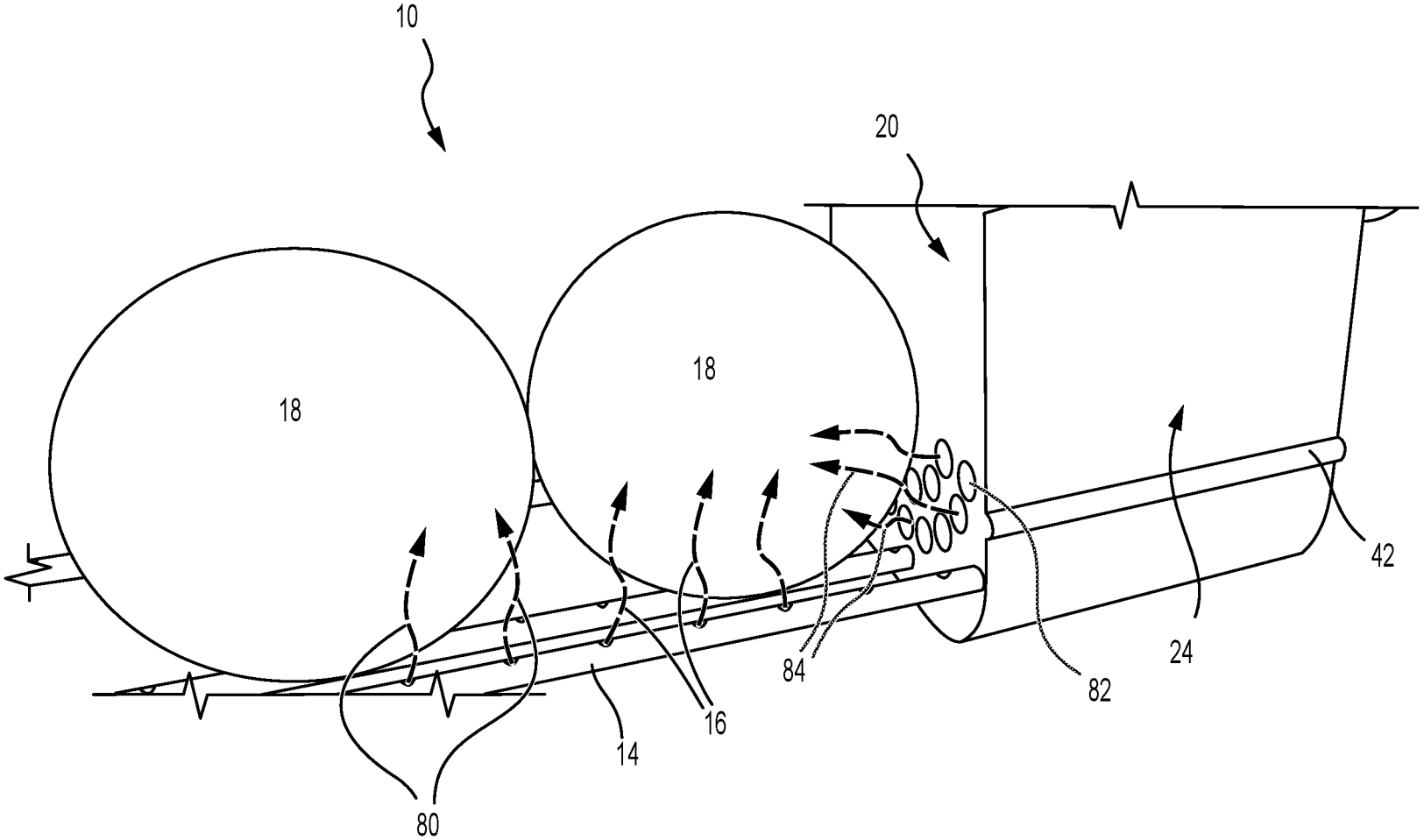
FIG. 6 is a schematic showing airflow of the system.

Referring now to FIG. 6 of the drawings, it can be seen how the perforations 16 in the tubular rails 14 permit warm, dried air to be blown out 80 over the balls 18 supported on the rails 14. In addition, the end stop wall 20 of the housing 24 also comprises through apertures 82 in fluid communication with the plenum 62 of the housing 24. This permits further warm dried air 84 to be blown out over the balls 18 supported on the rails 14. This "air wash", in particular, in conjunction with the shielding provided by the cover 40 (not shown in FIG. 6 for clarity) provides a reliable environment control system for the balls 18 when they are not in-play.

The invention is not restricted to the details of the foregoing embodiments, which are merely exemplary.

The invention claimed is:

1. A snooker pocket rail system comprising:

a ball ring from which the pocket rail is suspended, in use, below a pocket by a net;

an end stop;

a plurality of rails affixed at one end to the ball ring and at their opposite ends to the end stop; and suspension means that suspends, in use, the end stop below a table, wherein the snooker pocket rail further comprises an atmospheric control system for heating the atmosphere in a region adjacent the rails where one or more balls are supported in use.

2. The snooker pocket rail system of claim 1, wherein the atmospheric control system comprises means for heating the rails.

3. The snooker pocket rail system of claim 2, wherein the means for heating the rails comprises the rails being manufactured from tubes with heating elements located within the interior bore of the tubes.

4. The snooker pocket rail system of claim 2, wherein the atmospheric control system comprises a housing containing a fan and a heater and wherein at least one rail is tubular, a downstream side of the fan being in fluid communication with the bore of the tubular rail, so as to direct heated air inside the rail so as to heat it.

5. The snooker pocket rail system of claim 4, wherein the tubular rail is perforated or apertured to as to direct heated air inside the rail towards and/or over a ball supported by the rail.

6. The snooker pocket rail system of claim 1, wherein the atmospheric control system comprises a housing containing a fan and a heater, a downstream side of the fan being in fluid communication with one or more apertures in a wall of the housing, the apertures being arranged to direct heated air towards and/or over a ball supported by the rails.

7. The snooker pocket rail system of claim 4, wherein the housing further comprises a receptacle for retaining a quantity of desiccant, for drying the air.

8. The snooker pocket rail system of claim 1, wherein the atmospheric control system comprises a heater coil located within or around a rail.

9. The snooker pocket rail system of claim 1, wherein atmospheric control system comprises a cover surrounding the rails where balls are supported on the rails in use.

10. The snooker pocket rail system of claim 9, wherein the cover comprises a thermally insulating material.

11. The snooker pocket rail system of claim 9, wherein at least part of the cover is transparent.

12. The snooker pocket rail system of claim 11, wherein the transparent part of the cover is manufactured from transparent, insulating glass.

13. The snooker pocket rail system of claim 9, wherein the cover is slidingly or hingedly connected to the housing.

14. The snooker pocket rail system of claim 1, wherein the atmospheric control system comprises a thermostatic controller for controlling the temperature of the atmosphere in the region of the rails where a ball is supported, in use.

15. The snooker pocket rail system of claim 1, comprising two rails.

16. The snooker pocket rail system of claim 1, comprising three rails.

17. The snooker pocket rail system of claim 1, wherein the suspension means comprises a flexible strop affixed to the end stop.

18. A snooker, pool or billiards table comprising one or more snooker pocket rail systems according to claim 1.

19. The snooker pocket rail system of claim 5, wherein the housing further comprises a receptacle for retaining a quantity of desiccant, for drying the air.

20. The snooker pocket rail system of claim 6, wherein the housing further comprises a receptacle for retaining a quantity of desiccant, for drying the air.

* * * * *